US006403903B1

(12) United States Patent
Montano et al.

(10) Patent No.: US 6,403,903 B1
(45) Date of Patent: Jun. 11, 2002

(54) LIGHT SWITCH EXTENSION

(75) Inventors: Robert L. Montano, San Diego; Richard S. Carlisle, Oceanside, both of CA (US)

(73) Assignee: Pro-Perfect, Inc., Dana Point, CA (US)

( * ) Notice: Subject to any disclaimer, the term of this patent is extended or adjusted under 35 U.S.C. 154(b) by 0 days.

(21) Appl. No.: 09/503,414

(22) Filed: Feb. 14, 2000

(51) Int. Cl.[7] ..... H01K 3/02
(52) U.S. Cl. ..... 200/331
(58) Field of Search ..... 74/543, 544; 174/66, 174/67; 200/17 R, 38 R, 52 R, 330, 331

(56) References Cited

U.S. PATENT DOCUMENTS 2,582,379 A * 1/1952 Goldberg ..... 200/331
4,454,401 A * 6/1984 Powis, Jr. ..... 200/331
4,590,345 A * 5/1986 Marshell ..... 200/331
5,055,645 A * 10/1991 Hull et al. ..... 200/331
5,577,602 A * 11/1996 Conner et al. ..... 200/331
5,875,886 A * 3/1999 Elster ..... 200/331

* cited by examiner

*Primary Examiner*—Michael Friedhofer
(74) *Attorney, Agent, or Firm*—Donn K. Harms

(57) ABSTRACT

A wall switch extension is provided for operation of a wall switch in which a single rigid extension is attached to either a conventional toggle or a rocker type wall switch for rotation thereto. The extension includes separate methods for engaging the lever of the toggle switch and the operating surface of the rocker. Upon rotation of the extension the switch can either be turned on or turned off. A decorative member is positioned over and pivotally attached to the extension and is fixedly attached to the switch housing. To further enhance the visual presentation of the wall switch extension, the extension is configured to form a visual continuation of the decorative member.

9 Claims, 1 Drawing Sheet

LIGHT SWITCH EXTENSION

BACKGROUND OF THE INVENTION

The invention is directed to a toggle or pivotal switch and more particularly to an extension for switch activation by a person that cannot normally reach the conventional switch operator and more particularly to an extension in the configuration of a fanciful design.

U.S. Pat. No. 5,557,602 teaches a switch extender for ether a toggle switch and when modified for use on a rocker switch. To use the extender for the switch activation the face plate attached to a conventional wall switch is translated up and down activating a toggle switch and when modified actuates a rocker type wall switch in as similar manner. The face plate is non-decorative and appears to have a limited switch operator extension. The extender of this invention requires a modification for use with a rocker switch.

U.S. Pat. Nos. 5,055,645, 5,017,746 and 3,825,710 operated a toggle switch by up and down action rather than rotational movement as Applicant's and cannot be used with rocker type switches.

U.S. Pat. No. 4,562,325 teaches a rotary type toggle switch operator. The rotation requires the operation of two individual activation pull cords, i.e. one for turning the switch on and a second for turning the switch off. There is no operator means for use with a rocker type switch.

SUMMARY OF THE INVENTION

The instant invention is directed to a decorative combination toggle switch and rocker switch operator having a rotatable extended actuator that extends the "on" and "off" actuation of the switch to a lower elevation that the normal switch operator. The lower reach for switch actuation is beneficial for small children as well as short, handicapped persons or the like requiring a lower switch operator than normally provided.

The switch extender has an extension arm that when used with a toggle type switch includes an aperture for receiving the normal switch operator. The extension arm is pivotally attached off center from the switch operator to a decorative front panel in the shape of an animal or the like. The front panel is attached by screws passing partially through the front surface and threading into the normal screw threads of the switch housing. Spacers are positioned over the screws between the back surface of the front panel and the switch housing.

The extension arm further includes a pair of cam surfaces that when mounted to the front panel and switch housing as above mentioned operates a rocker type switch in the same manner as the toggle switch.

The extension arm activates the switches by rotating from left to right. In one direction of rotation the switch is activated and in the other direction the switch is inactivated.

The front panel takes the general form of a fanciful animal and the extension arm is a fanciful tail for that animal.

The principal object of the instant invention is to provide a conventional wall switch extension that has a fanciful configuration for lowering the switch operator to accommodate children, short and handicapped individuals.

Another object of this invention is to provide a wall switch extender that is operable without modification on both toggle and rocker switches.

Still another object of this invention is to provide a wall switch extender in the fanciful design of an animal and the switch operator in the form of a fanciful design of a tail for that animal.

Other objects and advantages will become obvious when taken into consideration with the following drawings and specifications.

DETAILED DESCRIPTION OF THE PREFERRED EMBODIMENT

Figure 1:
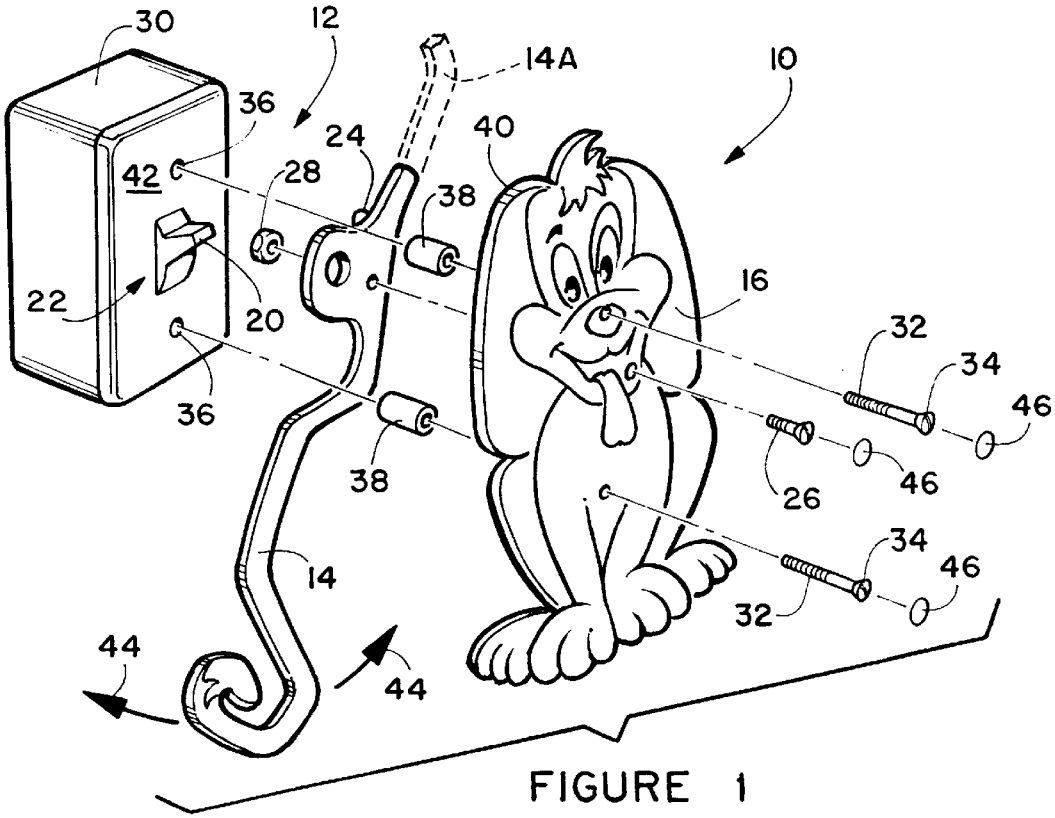
FIG. 1 is an exploded perspective showing of the invention and its relation to a conventional wall switch of the toggle type.

Referring now specifically to drawing FIG. 1, an exploded view of the switch extender assembly 10 of the invention is shown and its position relative to a conventional wall switch 12. The switch extender assembly comprises a extension arm 14 and a front panel 16. As shown, the front panel 16 is in the form of a fanciful dog and the extension arm is in the form of a fanciful tail for the dog. It should be understood that the front panel 16 can take any form of different fanciful showing of an animal or any other design to practice the invention. Likewise the extension arm can be a fanciful tail for a different animal or any other design related to the front panel.

Figure 2:
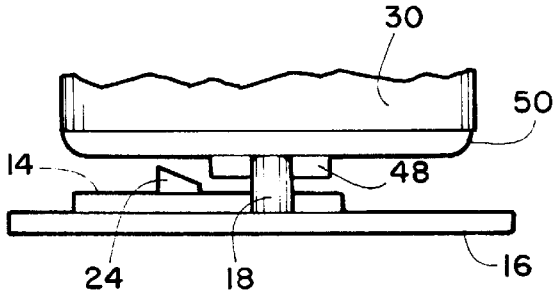
FIG. 2 is a detailed showing of the cam operators on the extender for operating a rocker switch.

The extension arm 14 has an aperture 18 through which the toggle 20 of toggle switch 22 is inserted. The extension arm 14 has a pair of cam surfaces 24 herein after explained in detail in the discussion of drawing FIG. 2. The extension arm 14 is pivotally attached to the front panel 16 by bolt 26 and nut 28. The extension arm attachment to the front panel is offset from the toggle switch to allow for rotation of the extension arm to toggle the switch.

Figure 3:
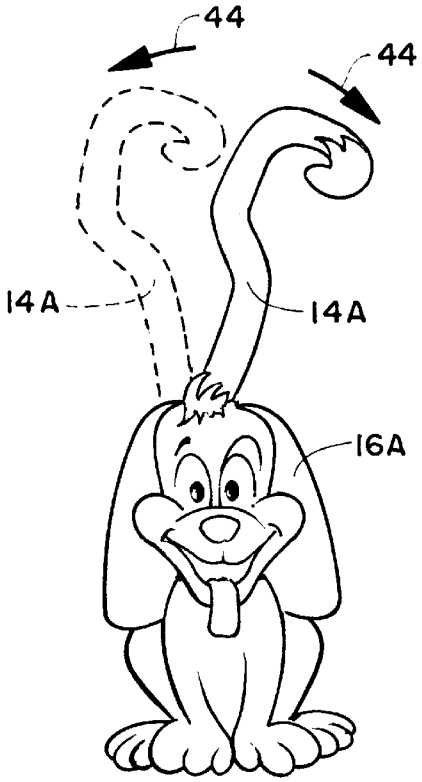
FIG. 3 is a front view of the switch extender assembly with an arrow showing the direction of operation of the extension member for operating the "on" and "off" action of the wall switch.
Figure 4:
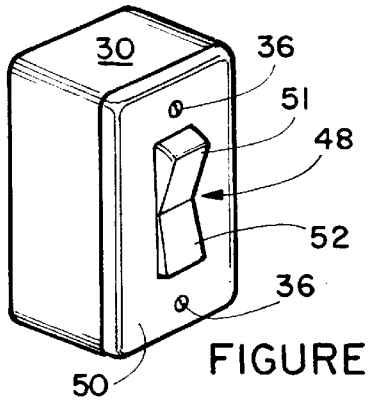
FIG. 4 is a showing of a rocker switch shown in the detail of drawing FIG. 3.

The front panel 16 is fixedly secured to the switch housing 30 by a pair of screws 32 that pass through the front panel 16 and are held to the front of the front panel by enlarged heads 34. The screws engage the switch housing 30 through openings 36 conventionally provided when the housing is manufactured. Bushings 38 are positioned between the back surface 40 of the front panel and the switch front cover 42 so as to allow rotationally movement of the extension arm to toggle the switch between activated and inactivated as shown by arrow 44 of drawing FIG. 3. Decorative caps 46 that correspond with the outer surface design of the front panel 16 are adhered to the screw heads 26 and 34 for concealment thereof Referring now specifically to drawing FIGS. 2 and 4, a rocker type switch 48 is shown having a switch housing 30 and a differently configured front cover 50 having similar openings 36 to screw the front panel to the switch housing as discussed above. The extension arm 14 pivotally mounts to the front panel 16 and the front panel mounts to the housing in the same manner as discussed above. To operated the rocker type switch a pair of opposed cam surfaces 24 (one shown as the other is immediately behind the visual cam surface). As the extension arm 14 is rotated in one direction along arrow 44 one of the cam surfaces either engages the surface 51 position forcing the contacted surface from a position 51 position to a surface position as surface 52 in the drawing. Rotating the extension arm in the opposite direction along arrow 44 depresses the then rocker in the surface 51 configuration to the surface 52 configuration. Obviously, the switch is activated to "on" in one position and inactivated to "off" in the other position.

The materials of construction can be chosen from any material suitable for the purpose intended. As for example and not by way of limitation plastic, wood, metal or the like may be used.

Although the invention has been herein shown and described in what is conceived to be the most practical and preferred embodiments, it is recognized that departure may be made therefrom within the scope of the invention, which is not to be limited to the details disclosed herein but it is to be accorded the full scope of the claims so as to embrace any and all equivalent devices and apparatus.

We claim:

1. A wall switch extension for permitting operation of a wall switch having a mounting housing comprising:

a single rigid extension means for attaching to a conventional toggle or rocker type wall switch for rotation relative thereto, said extension means comprising in combination separate means for engaging the lever of a toggle type switch and separate means for engaging the operating surface of a rocker type switch, rotation of said extension means in a first direction the causes the wall switch to be switched to a switch on position and when rotated in a second direction opposite to said first direction causes said wall switch to be activated to a switch off position;

a decorative member having a front and back surface positioned over and pivotally attached to said extension means and fixedly attached to said switch mounting housing; and said extension means configured to form a visual continuation of said decorative member.

2. The invention as defined in claim 1 wherein said separate means for engaging the lever of said conventional toggle type switch is an aperture through said extension means.

3. The invention as defined in claim 1 wherein said separate means for engaging said rocker type switch is a pair of spaced apart cam surfaces.

4. The invention as defined in claim 1 additionally comprising means for mounting said decorative member to said switch mounting housing.

5. The invention as defined in claim 4 wherein said mounting means comprises a pair of threaded bolts that pass through apertures in said decorative member and a pair of bushings, one bushing for each of said threaded bolts inserted on said bolt intermediate said back surface and said switch mounting housing for spacing said decorative member from said housing, said threaded bolts having an exposed surface when inserted into said apertures.

6. The invention as defined in claim 5 additionally comprising decorative colored caps for placement over the threaded bolt's exposed surface for concealment thereof.

7. The invention as defined in claim 1 wherein said decorative member is a fanciful animal and said extension means is a fanciful shaped tail of said animal.

8. The invention as defined in claim 1 wherein said wall switch extension is constructed of plastic.

9. The invention as defined in claim 1 wherein said single rigid extension extends upward from said switch.

* * * * *